US009154887B2

(12) United States Patent
Westerkull

(10) Patent No.: US 9,154,887 B2
(45) Date of Patent: Oct. 6, 2015

(54) BONE CONDUCTION HEARING AID SYSTEM

(71) Applicant: Otorix AB, Askim (SE)

(72) Inventor: Patrik Westerkull, Askim (SE)

(73) Assignee: Otorix AB, Askim (SE)

( * ) Notice: Subject to any disclaimer, the term of this patent is extended or adjusted under 35 U.S.C. 154(b) by 0 days.

(21) Appl. No.: 14/535,259

(22) Filed: Nov. 6, 2014

(65) Prior Publication Data

US 2015/0063616 A1 Mar. 5, 2015

Related U.S. Application Data

(63) Continuation-in-part of application No. 14/250,618, filed on Apr. 11, 2014, now abandoned, which is a continuation-in-part of application No. 14/017,593, filed on Sep. 4, 2013, now abandoned, which is a continuation-in-part of application No. 13/963,186, filed on Aug. 9, 2013, now abandoned.

(51) Int. Cl.
*H04R 25/00* (2006.01)

(52) U.S. Cl.
CPC ..... *H04R 25/00* (2013.01); *H04R 25/60* (2013.01); *H04R 25/606* (2013.01); *H04R 2225/021* (2013.01); *H04R 2225/67* (2013.01); *H04R 2460/13* (2013.01)

(58) Field of Classification Search
CPC .... H04R 1/1075; H04R 25/60; H04R 25/606; H04R 25/65; H04R 2201/10; H04R 2225/021; H04R 2225/67; H04R 2420/07; H04R 2460/13
USPC ..... 381/312, 322, 324, 326, 328, 151, 380; 600/25
See application file for complete search history.

(56) References Cited

U.S. PATENT DOCUMENTS

| | | | | |
|---|---|---|---|---|
| 2,459,325 | A * | 1/1949 | Knowles | 381/151 |
| 4,390,576 | A | 6/1983 | Hutter, III | |
| 6,377,693 | B1 | 4/2002 | Lippa et al. | |
| 7,386,143 | B2 | 6/2008 | Easter et al. | |
| 8,787,607 | B2 * | 7/2014 | Andersson | 381/326 |
| 2008/0319250 | A1 | 12/2008 | Asnes | |
| 2012/0078035 | A1 * | 3/2012 | Andersson et al. | 600/25 |
| 2012/0294466 | A1 | 11/2012 | Kristo et al. | |
| 2014/0064531 | A1 | 3/2014 | Andersson et al. | |

FOREIGN PATENT DOCUMENTS

| | | |
|---|---|---|
| JP | 2011087142 | 4/2011 |

* cited by examiner

*Primary Examiner* — Huyen D Le
(74) *Attorney, Agent, or Firm* — Fasth Law Offices; Rolf Fasth

(57) ABSTRACT

A bone conduction hearing aid system for generating bone conduction vibrations is disclosed. The bone conduction hearing aid system has a hearing aid with a vibrator. The hearing aid system includes an interconnection unit to connect the hearing aid to the user. There is a coupling between the interconnection unit and the hearing aid to connect and disconnect the hearing aid to and from the interconnection unit. The interconnection unit has connection portion and contact plate portion. The connection portion and the contact plate portion are designed in one integral piece of continuous polymer material. The interconnection unit has a concave or planar adhesive surface that can be adhered to the skin on the head of the user without applying any specific pressure against the skin. The sound vibrations are transmitted from the vibrator to the hearing organ as bone conduction sound vibrations.

11 Claims, 7 Drawing Sheets

Fig 7A
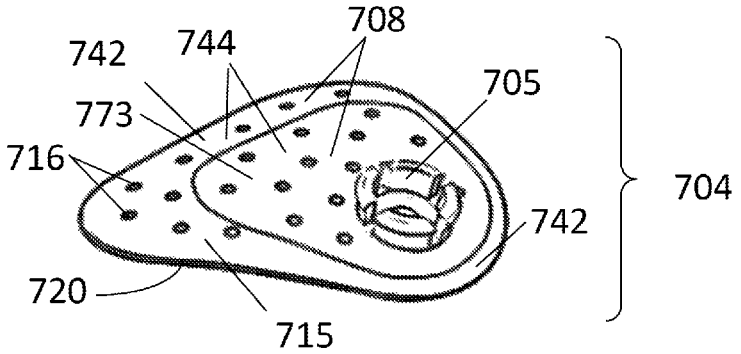
Fig 7B
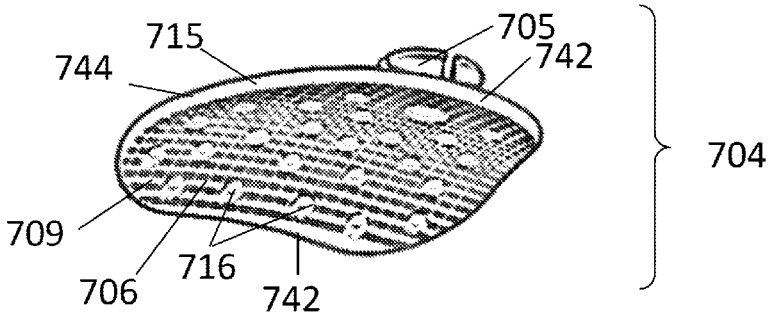
Fig 7C
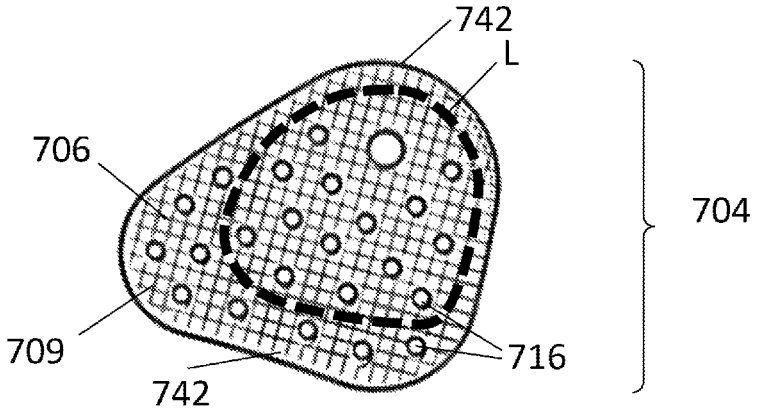
Figs 7 A – 7 C.

BONE CONDUCTION HEARING AID SYSTEM

PRIOR APPLICATIONS

This is a continuation-in-part application of U.S. patent application Ser. No. 14/250,618, filed 11 Apr. 2014 that is a continuation-in-part application of U.S. patent application Ser. No. 14/017,593, filed 4 Sep. 2013 that is a continuation-in-part application of U.S. patent application Ser. No. 13/963,186, filed 9 Aug. 2013.

TECHNICAL FIELD

The present invention relates to a hearing aid system for providing bone conduction hearing.

BACKGROUND AND SUMMARY OF THE INVENTION

Bone conduction is the conduction of sound to the inner ear through the bones of the skull, and a bone conduction hearing aid, or bone conductor, is a device that stimulates through bone conduction. Other types of hearing aids may instead directly stimulate the tympanic membrane, the middle ear ossicles, the round window, the oval window or the cochlear fluid. Several different types of bone conduction hearing aids are available. A bone conduction hearing aid may amplify sound or it may also work as a tinnitus masker. A bone conductor may also be used in audiometry to determine bone conduction hearing thresholds. Current bone conductors include however several drawbacks, as described below.

The traditional bone conductor consists of a hearing aid with a vibrator that is pressed against the head behind the ear by a spring arrangement extending from the other side of the head. The steel spring arrangement is sometimes built into an eyeglass frame. The vibrations are transmitted through the skin and the skull bone into the inner ear. For the traditional bone conductors with a spring arrangement around the head, the constant pressure against the skull bone often causes headaches and skin irritation. A constant pressure against living tissue tends to lead to poor blood supply and irritation. The spring arrangement is also bulky and is not a practical or user friendly solution.

Another type of established bone conductor, which is sometimes called a direct bone conductor, includes a vibrator, which is directly and firmly connected to an anchoring component that is anchored to the skull bone through which the vibrations are directly transmitted from the vibrator to the skull bone. The vibrations do not pass through the skin on its way from the vibrator to the skull bone. This type of bone conductor may be designed with a permanent skin penetration which may lead to problems with skin infections. If this type of bone conductor is instead designed with an implanted vibrator and where energy are transmitted from an external hearing aid there is a significant energy loss when transmitting the energy with an inductive link through the skin. Another drawback is that the vibrator cannot easily be repaired if it breaks down.

To avoid the need for surgery or bulky spring arrangements, adhesively attached bone conductors have also been suggested, however these have not become successful. To transmit the vibrations to the skull, these suggested adhesive bone conductors includes a protruding portion pressing towards the skin. The pressure is achieved by the surrounding adhesive attached to the skin. The drawbacks are that there will still be a constant pressure against the skin and the arrangement tends to come loose since there will be a constant force trying to remove the adhesive from the skin since it is the adhesive is counteracting the pressure force from the protruding portion. To try to adjust this type of device the protruding portion is made adjustable with a screw to try to make it work and the arrangement then becomes more complex and expensive due to its design. Other suggestions such as taping the bone conductor to the head have not become successful arrangements. Some of these arrangements also required removal of the adhesive from the skin to remove the bone conductor which may cause too frequent stress on the skin.

Another type of bone conductor is a type where the vibrator is placed in an external unit outside the skin and where this external unit is kept in place through a magnetic attachment to a part that is anchored to the skull bone and implanted under the skin. In this arrangement, the signal from the external part is passing through the skin to the implanted part and the skull bone. For this type of bone conductor, surgery is still required and the pressure towards the skin may cause skin necrosis due to the constant pressure against the skin. When a magnetic attachment is used, the hearing aid may also easily fall off.

For all non-surgical bone conductors, the firmly established design tradition has been that the arrangement has to include some sort of member creating a pressure against the skin to obtain a sufficient transmission of the vibrations from the vibrator to the skull. Applying a pressure against the skin improves the transmission through the skin. With an improved transmission through the skin, the hearing aid with the vibrator, electronics and battery can be made smaller and does not have to be as powerful as if there were no pressure against the skin. There has been a long tradition in the industry of trying to make the hearing aid systems as small and as light-weight as possible for the convenience of the user. Due to this strong trend and tradition, the industry has been completely focused on designs that require that a pressure against the skin must be created by the hearing aid system. This has almost been a dogma. In spite of many efforts during several decades, no system has become successful because the pressure makes the device fall off, irritates the skin or becomes complicated particularly when adjustable arrangements are used. Since pressure against the skin in an adhesive bone conductor has to, in some way, include a protruding area or component, previous solutions have not included any kind of soft rubber portions to follow the curvature of the head of the individual since such portions would not contribute to the creation of a pressure against the skin.

For conventional adhesive bone conductors, the coupling between the hearing aid and the adhesive carrier has been placed at the center of the carrier. The coupling has been placed at the center to reduce the risk of the adhesive coming loose from the skin due to the weight of the hearing aid. However, the general anatomy of the hair free area behind the ear is such that the placement of the coupling at the center results in the coupling and the hearing aid touching the outer ear causing undesirable acoustic feedback and discomfort.

Furthermore, the industry has been completely focused on arrangements where only the adhesive component in itself has been the disposable single-use component that has been replaced when it does not adhere well to the skin anymore. It has been the established design tradition to have a complex component carrying the adhesive component. A double-sided adhesive-sheet, for example, is inexpensive but it is difficult for the patient to replace it on the carrier and the remaining adhesive disposed around the edges often collects dirt and bacteria. There is a need for a more effective bone conduction hearing aid system that is reliable and does not have the drawbacks discussed above.

The present invention provides an effective solution to the above-outlined problems of bone conduction hearing aids. More particularly, the bone conduction hearing aid system of the present invention has a hearing aid device with a vibrator disposed in a hearing aid housing. The hearing aid device has a first connection portion. Furthermore, the bone conduction hearing aid system of the present invention has an interconnection unit that has a contact plate portion and a second connection portion. The second connection portion is located on a first side of the contact plate portion. The contact plate portion has a second side at least partly provided with an adhesive component. The second side is configured to, when in use, face a skin of a user of the bone conduction hearing aid system. The first connection portion of the hearing aid device is connectable to the second connection portion of the interconnection unit so that these two portions form a coupling. The adhesive component has a first adhesive side and a second adhesive side. The first adhesive side is attached to the second side of the contact plate portion and the second adhesive side is adhesively attachable to a skin of a user. The present invention allows the interconnection unit with the adhesive component to be at least partly positioned between the hearing aid device and the skin of the user to enable a practical and cosmetic solution. The present invention also allows the hearing device to be connected to and disconnected from the interconnection unit without having to, at the same time, connect or disconnect the interconnection unit to the skin of the user. The contact plate portion and the second connection portion are made in one piece continuous injection molded polymer material and this unique design makes it possible to manufacture the entire interconnection unit in one injection molded part with an attached adhesive component which makes it possible to do the interconnection unit as a low cost disposable component.

The second connection portion protrudes from the first side of the contact plate portion which makes it easier to locate the second connection portion when connecting the hearing aid to the interconnection unit. In the present invention, one of the first and the second connection portion is a female connection portion and the other one of the first and the second connection portion is a male connection portion. The male connection portion is at least partly insertable into the female connection portion and one of the female and male-connection portion is flexible with a snap-in ridge and the other of the first and the second connection portion having a circular rigid coupling ridge to ensure a secure retention when attached. In the bone conduction hearing aid system of the present invention the second side of the contact plate portion is concave or planar without convex areas and without protruding means from the interconnection unit, i.e. there are no protruding parts or portions designed to cause specific pressure against the skin. This unique design is critical for the success of the invention since this offers a much more secure adhesive retention of the hearing aid system than if the adhesive would have to counteract a specific pressure against the skin. The lack of specific pressure against the skin is also more skin friendly. Our research has surprisingly shown that bone conduction vibrations can be successfully transmitted from an external vibrator to the skull also without any pressure applied to the skin. The reason for this successful transmission may be due to the incompressibility of skin tissue which might not have been fully considered before.

The interconnection unit of the bone conduction hearing aid system of the present invention has preferably a weight lower than 2 grams and the contact plate portion has preferably at least 5 through holes to enable moist transportation and these holes also contribute to keeping the weight down.

In a preferred embodiment of the bone conduction hearing aid system of the present invention, the second connection portion is positioned non-centrically on the first side of the contact plate portion so that a front end of the contact plate portion extends at least twice as far out from a center point of the second connection portion compared to the extension of a rear end of the contact plate portion. These proportions are essential to use the non-hair-bearing area behind the ear for adhesion and still enable a suitable attachment of the hearing aid device without interfering with the outer ear.

In a preferred embodiment of the bone conduction hearing aid system of the present invention, the first connection portion is a rigid female connection and the second connection portion is flexible male connection and wherein the flexible male connection portion has at least two flexible spring arms having a snap-in ridge at a connection end of the spring arms.

In a preferred embodiment of the bone conduction hearing aid system of the present invention, the second connection portion is a rigid male connection portion protruding a distance out from the first side that is at least the 50% of an average thickness of the contact plate portion. These proportions are essential both to keep the thickness of the contact plate portion down and to ensure an efficient function of the second connection portion.

In a preferred embodiment of the bone conduction hearing aid system of the present invention, the contact plate portion has a flexible peripheral frame around at least part of the periphery of the contact plate portion so that it can be more easily adapted to a curvature of the head of a user. The contact plate portion is preferable still fairly rigid to offer a stable base for the use of the second connection portion.

In a preferred embodiment of the bone conduction hearing aid system of the present invention, the contact plate portion is at least partly transparent to allow at least one of visible light and UV light to be transmitted through the contact plate portion to the adhesive component.

In a preferred embodiment of the bone conduction hearing aid system of the present invention, the adhesive component has a light sensitive switchable release agent that is transformable to change at least the adhesive component of the second adhesive side from a high adhesive state providing a high adhesive strength to a low adhesive state providing a low adhesive strength that is lower than the high adhesive strength. With this design it is possible to minimize the stress on the skin when tearing off the interconnection unit from the skin.

The contact plate portion and a second connection portion of the present invention is preferably manufactured in a single injection molding cavity having a shape of the contact plate portion and the second connection portion together. A melted polymer is then injected into the cavity, thus forming a contact plate portion and a second connection portion in one unit made of the polymer, and then the unit is ejected from the molding cavity after cooling down.

The hearing aid device can be standardized since the coupling to the interconnection unit can be the same for more or less all patients which is important since the hearing aid is quite expensive. The interconnection unit that is more frequently changed and cost efficient to manufacture can, however, easily be manufactured in various shapes and sizes to fit different users.

The present invention is unique since it works without any protruding parts in the adhesive area that cause pressure against the skin. Because the skin pressure is minimal, the retention is secure and skin friendly. The design of the present invention enables an adhesive interconnection unit to be cost-efficiently produced as a single use disposable component which is important for practical and cost aspects.

The present invention goes against the established design tradition. One drawback of the present invention is that it requires a more powerful hearing aid device since it works without any pressure against the skin. As explained above, conventional thinking in the hearing aid industry has been to focus on minimizing size and weight and therefore prior art designs have relied on applying a pressure against the skin because that improves the conduction from the hearing aid devices into the skull of the user and thus make it possible to use small and light-weight devices. Another drawback of the design of the present invention is that there is no adjustable member that could be used to create and adjust the pressure against the skin in case a patient prefers more power at some time. However, it has surprisingly been found that the advantages of reduced risk of fall off the skin, less skin irritation and less complicated design requirements outweigh the drawbacks of the need for a more powerful hearing aid device that is heavier and bigger than conventional designs. Although the hearing aid device of the present invention needs to be more powerful and is therefore usually bigger and heavier compared to conventional designs , the retention is still more secure and it is more skin friendly compared to conventional design that requires a constant pressure against the skin. A somewhat heavier hearing aid device of the present invention may also be compensated by the fact that the interconnection unit can be made very light when it is an integrated part without adjustable parts, and therefore the total weight of the arrangement carried by the adhesive may still be similar to conventional designs.

The interconnection unit of the present invention where the contact plate portion and the second connection portion are made integral enables the entire interconnection unit to be a cheap disposable component. This is a key to make the arrangement hygienic and practical to handle. A drawback of the present invention is that the interconnection unit is a more expensive disposable component than if only the adhesive component was changed when the adhesive does not adhere sufficiently to the skin anymore. However, surprisingly the advantages of replacing the entire unit instead of just the adhesive sheet outweigh the drawbacks of higher costs since it is much more practical for the patient and the replacement of the entire unit significantly improves the hygiene. Also, the material of the interconnection unit is preferably recycled for environmental purposes.

The solution of the present invention go against several established design parameters as described above and the result is a surprisingly excellent hearing aid system where the advantages outweigh the drawbacks and the present invention provides valuable improvements in hearing rehabilitation.

As described above, the bone conduction hearing aid system of the present invention includes a unique combination of solutions and provides new solutions and several advantages to meet complex user requirements.

BRIEF DESCRIPTION OF THE DRAWINGS

FIG. 7A is a perspective top view of the interconnection unit of the present invention;

FIG. 7B is a perspective bottom view of the embodiment shown in FIG. 7A shown from a different view;

FIG. 7C is a bottom view of the embodiment shown in FIG. 7B shown from a different view.

DETAILED DESCRIPTION

Figure 1:
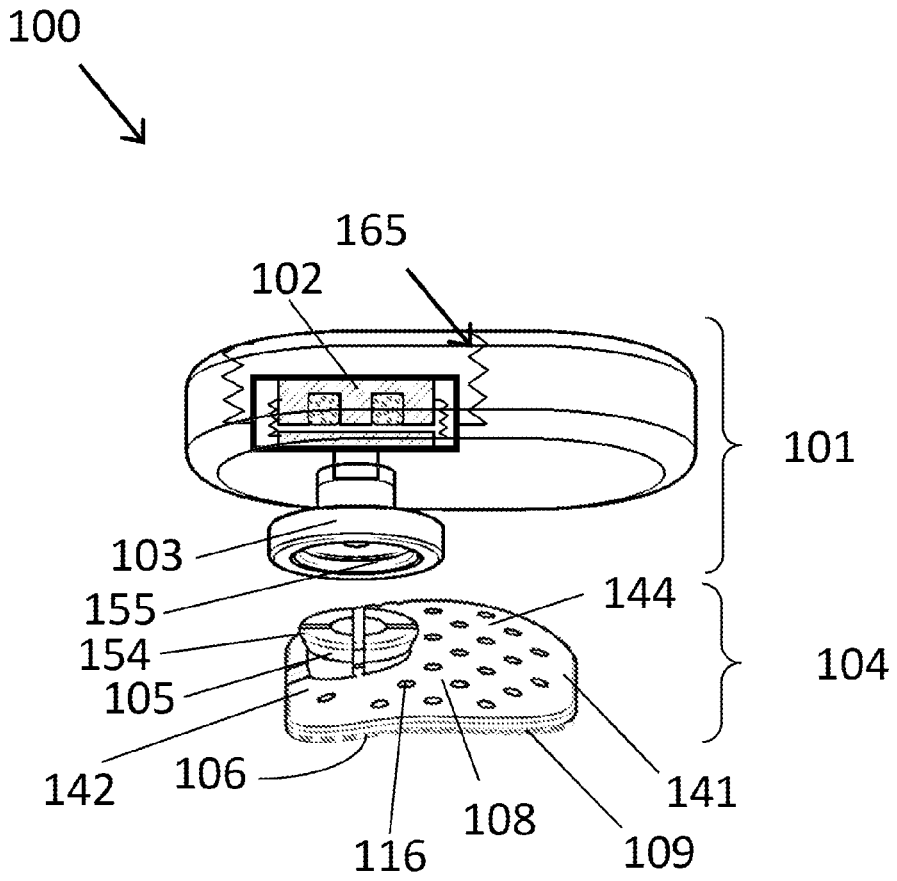
FIG. 1 is a perspective side view overviewing the bone conduction hearing aid system of the present invention when the hearing aid device is not connected to the interconnection unit, and where the vibrator of the hearing aid device has been visualized.

One important realization and insight of the present invention is that it is possible to provide an effective hearing aid system without the need for the contact portion of the hearing aid device applying a pressure on the bone behind the ear to improve the transmission of the sound. It was a surprising discovery that although a hearing aid device 101 of the present invention must use a more powerful vibrator 102 and is therefore heavier than conventional hearing aid devices (which is against conventional thinking of using devices that are as light as possible), these drawbacks are outweighed by the advantages of a better adhesion to the skin (since there is no pressure from a protrusion that counteracts the adhesion force), less skin irritation (because the skin becomes more irritated when subject to constant pressure) and less complicated contact portion (since there is no need for any adjustment mechanism to adjust the pressure applied). Another important feature of the present invention is the unexpected realization that by making a contact plate portion 144 of a interconnection unit 104 very simple and integral with a connection portion 105, i.e. adjustment mechanisms or other movable components are eliminated, the interconnection unit can be made very light weight that sufficiently compensates for the heavier hearing aid device 101. There has also been conventional thinking that the user must be able to adjust the pressure applied to the bone so that the user can set the pressure to accomplish the best sound transmission while making sure the pressure is not too high to make it uncomfortable to use the hearing aid device. The idea of eliminating this feature is also against conventional thinking. In this way, the total weight of the hearing aid device 101 and the interconnection unit 104 is not that much heavier than conventional hearing aid devices. In other words, by going against conventional thinking and make the hearing aid device 101 more powerful and heavier to compensate for the poorer transmission (since no pressure is used) and make the interconnection unit 104 integral and very light weight without any adjustment mechanisms, the overall hearing aid system 100 becomes sufficiently light weight so that the drawbacks of conventional hearing aid systems can be eliminated. Another unexpected advantage is that because the interconnection unit 104 is made so simple it also becomes so inexpensive that the user can replace the entire interconnection unit 104, when there is insufficient adhesion, instead of replacing the adhesive tape which is often tricky to do particularly if the user is handicapped or old so that the user is less able to remove such adhesive tape. The idea of positioning the contact portion 105 non-centrically on the contact plate portion 144 is also against conventional thinking. A centrally positioned contact portion 105 would reduce the risk of the weight of the hearing aid 101 tearing off the interconnection unit 104 from a skin to which it is attached. On the other hand, a non-centrally positioned contact portion 144 better adapts to the general anatomy of the area behind the ear of a user by adhering to a large portion of the naturally non-hair bearing area without the hearing aid 101 touching the outer ear. The combination of relying on adhesion to keep the interconnection unit 104 in place behind the ear without applying a pressure against the bone and the non-centrically positioned connection portion 105 that is integral with the contact plate portion 144, making the interconnection unit 104 very light weight, are important features of the present invention.

FIG. 1 is a perspective side overview of the bone conduction hearing aid system 100 of the present invention. A hearing aid device 101 has a vibrator 102 (shown as a cross-sectional view) disposed therein. The vibrator 102 is connected to a first connection portion 103 of the hearing aid device 101. An interconnection unit 104 has a contact plate portion 144 having a first side 108 and a second side (not shown) opposite to the first side 108. A second connection portion 105 is located at the first side 108.

The first connection portion 103 and the second connection portion 105 form a coupling since they are connectable to each other. The second side has an adhesive component 109. The adhesive 109 component has a first adhesive side (not shown here) attached to the second side of the contact plate portion 144. The adhesive component 109 has a second side 106 that can be adhesively connected to the skin on the head of a user (best shown in FIGS. 2 and 3A-3D). The first connection portion 103 can be removably connected to the second connection portion 105 by inserting at least part of the second connection portion 105 into a cavity defined inside the portion 103. The, hearing aid device 101 can then transmit bone conduction vibrations to the hearing organ of the user (see FIG. 2). One useful feature is that the patient may simply remove the hearing aid device 101 by snapping the connection portion 103 from the second connection portion 105, and it may, preferably, require less force to remove the connection portion 103 from the connection portion 105 compared to removing the adhesive component 109 from the skin since the first connection portion 103 may be tilted to disconnect it from the second connection portion 105. In this way, the patient may easily remove the hearing aid device 101 from the interconnection unit 104 without inadvertently removing the interconnection unit 104 from the skin of the patient. To enable disconnecting the hearing aid device 101 from the unit 104 with a tilting force, the contact plate portion 144 of the unit 104 is sufficiently rigid so that the unit 104 is not deformed or bent when applying a tilting force since such deformation or bending may prevent the intended disconnection of the hearing aid device 101 from the interconnection unit 104 by using the above described tilting force.

The connection portion 103 is a rigid female portion of a durable material and the second connection portion 105 is a flexible male connection that may be made of a less durable material than the female connection portion 103, and this has the advantage that the wear from connecting and disconnecting will mainly be on the interconnection unit 104 which is a cheap disposable component compared to the hearing aid device 101. The second connection portion 105 has a snap-in ridge 154 that overlaps a corresponding circular coupling ridge 155 in the first connection portion 103 to keep the hearing aid 101 connected to the interconnection unit 104 when the connection portion 103 is connected to the second connection portion 105. The second connection portion 105 and the contact plate portion 144 is an integral injection molded plastic piece in a continuous polymer material which makes it possible to make the interconnection unit 104 as a cost efficient disposable product. By this injection molding in one piece, a low weight of the interconnection unit 104 can be achieved which is important both to improve the vibration transmission by reducing the mechanical impedance in the system and to reduce the risk for the interconnection unit 104 falling off from the head of the user. When the first connection portion 103 has been snapped onto the second connection portion 105, the flexible second connection portion 105 establishes a coupling force that keeps the hearing aid device 101 and the interconnection unit 104 together and allows sound vibrations to be transmitted from the vibrator 102 to the interconnection unit 104 and then further on to a user. The hearing aid device 101 may, in general, also include a microphone, electronics, battery and volume control which are not shown in the drawings. The hearing aid device 101 may include a signal generator to generate for example a noise signal for tinnitus masking or tones for audiometry. The hearing aid device 101 may also be connected with a cord to a conventional audiometer for audiometry.

Preferably, the interconnection unit 104 has a plurality of openings defined therethrough so that air and moisture may be transported through the interconnection unit 104 to reach portions of the patient's skin that is below the surface 106. Opening 116 is one such opening that has been marked.

The female first connection portion 103 can be turned about the center axis of the coupling relative to the male second connection portion 105 when the connection portion 103 is connected to the second connection portion 105. This is useful since it is then possible to adjust the orientation of the hearing aid device 101 when it is connected to the interconnection unit 104 attached to the user. Preferably, there should be sufficient friction between the first connection portion 103 and the second connection portion 105 to ensure that the hearing aid device 101 is still kept in an accurate position. The contact plate portion 144 has a front portion 141 and a rear portion 142. The front portion 141 is preferably placed closer to the ear of the user than the rear portion 142 when the interconnection unit is adhered to the skin behind the ear (best shown in FIG. 6). The second connection portion 105 is eccentrically positioned on the contact plate portion 144 and closer to or at the rear portion 142. In this way the adhesive interconnection unit 104 can adhere to a large portion of the non-hair-bearing skin area behind the ear and still enable a suitable attachment of the hearing aid device 101 where the hearing aid device 101 does not touch the outer ear of the user. This design offers a safer adhesive retention and minimizes the risk of acoustic feedback.

The hearing aid device 101 may also include a vibrator suspension device 165 that suspends the vibrator 102 from the housing of the hearing aid device 101 to minimize feedback problems.

Figure 2:
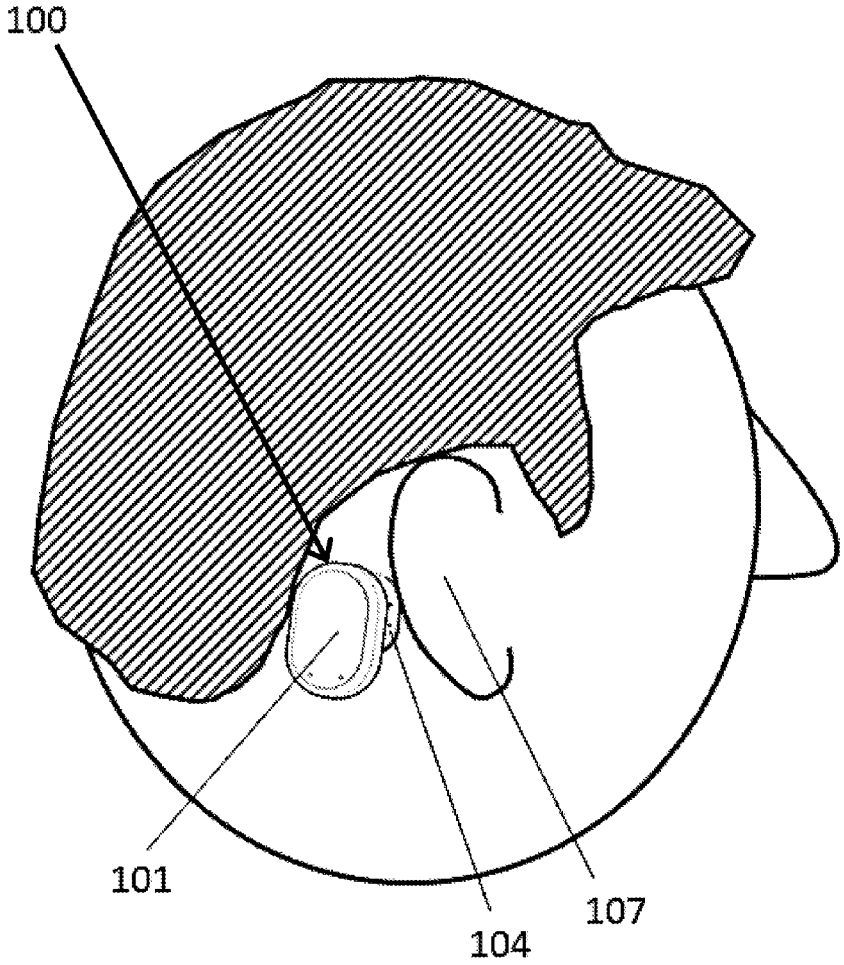
FIG. 2 is a perspective side view overviewing the bone conduction hearing aid system of the present invention when the bone conduction hearing aid system is connected to a user.

FIG. 2 is a perspective side overview of the bone conduction hearing aid system 100 of the present invention when it is in position on and attached to a user or patient. The hearing aid device 101 is connected to the interconnection unit 104 which is connected with an adhesive surface to the skin behind the ear 107 of the user. Sound vibrations are transmitted from the hearing aid device 101 via the interconnection unit 104 to the head of the user to stimulate the hearing organ through bone conduction.

Figure 3:
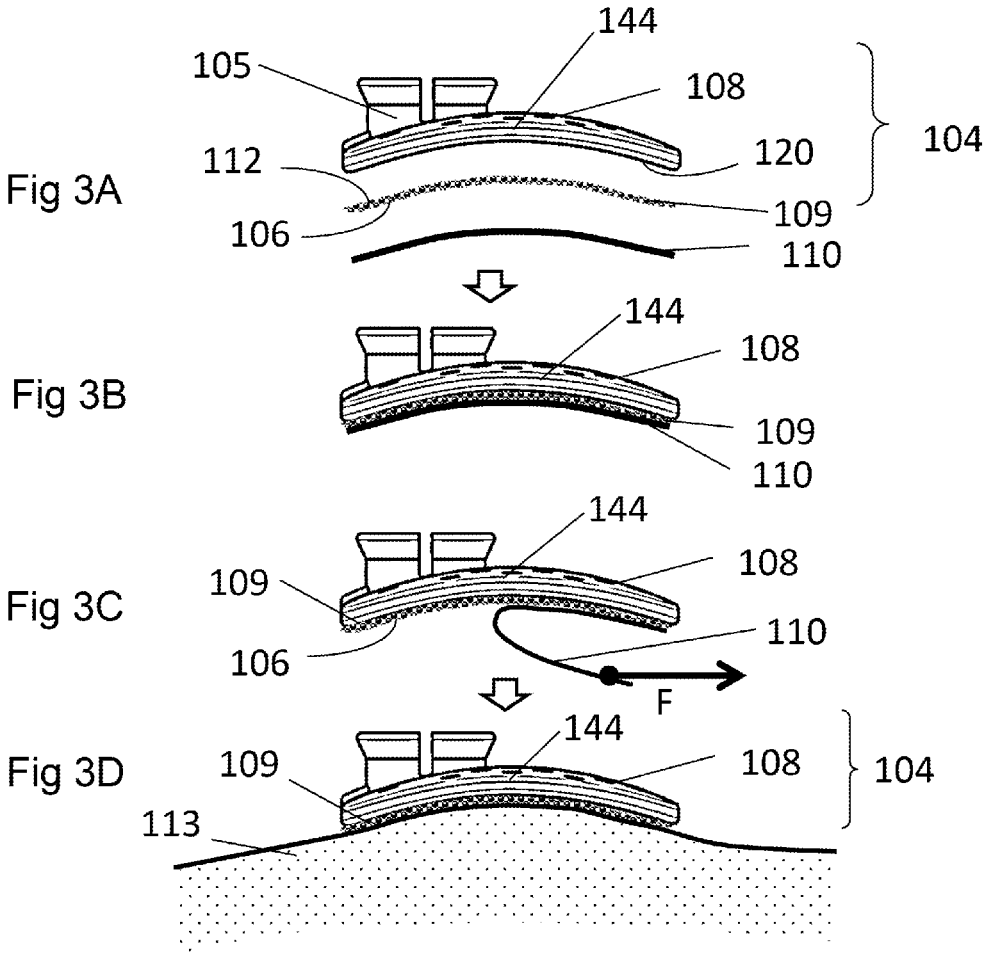
FIG. 3A is a side view of the interconnection unit of the present invention with an adhesive component and protective part separated from the contact plate portion of the interconnection unit.
FIG. 3B is a side view of the embodiment shown in FIG. 3A with the adhesive component and protective part attached to the contact plate portion of the interconnection unit.
FIG. 3C is a side view of the embodiment shown in FIG. 3B with the protective part partially removed.
FIG. 3D is a side view of the embodiment shown in FIG. 3C with the protective part fully removed and the embodiment attached to a skin portion of a user.

FIGS. 3A-3D are side views of the composition (FIG. 3A and FIG. 3B) and the application (FIG. 3C and FIG. 3D) of the interconnection unit 104 of the bone conduction hearing aid system of the present invention. In FIG. 3A the separated parts are shown before assembly in manufacturing. The contact plate portion 144 and the second connection portion 105 is an injection molded plastic component. The contact plate portion 144 has a first side 108 and a second side 120. The adhesive component 109 is a double-sided adhesive sheet with a first adhesive side 112 and a second adhesive side 106. The double sided adhesive sheet 109 may include a non-woven carrier material to offer a stable sheet with a sufficient thickness to allow a good most transportation in all directions of the double sided adhesive sheet 109. A protective liner sheet 110 is also shown.

In FIG. 3B, the parts shown in FIG. 3A have been assembled so that the double-sided adhesive sheet 109 has been adhered to the second side 120, and the protective liner sheet 110 has been attached to the other adhesive side 106 of the double-sided adhesive sheet 109 so that the unit is ready for transportation. In FIG. 3C, the protective liner sheet 110 is removed from the adhesive side 106 of the double-sided adhesive sheet 109 by applying a force (F) to expose the adhesive surface of the second adhesive side 106. In FIG. 3D, the interconnection unit 104 with its double-sided adhesive sheet 109 has been adhesively attached to a skin 113 on the head of a user. It is possible for the user to remove the interconnection unit 104 from the skin 113, for example, during a night so that the skin 113 is not permanently interfered with and can "breathe" and function normally when the patient does not need to use the bone conduction hearing aid system 100. The second side 120 of the contact plate portion 144 is concave without convex areas and without protruding means from the interconnection unit 104 so that there are no specific portions creating a specific constant pressure against the skin tissue 113, and this design improves both the adhesive retention and the skin interaction. The contact plate portion 144 may be transparent to light for both cosmetic and functional reasons. The adhesive component 109 may then also include a light sensitive switchable release agent so that the adhesive state of the second adhesive side 106 is transformable to change from a high adhesive state providing a high adhesive strength to a low adhesive state providing a low adhesive strength that is lower than the high adhesive strength to facilitate the removal of the interconnection unit 104 from the skin 104 by applying light or UV light to the interconnection unit 104. To prevent sunlight from activating the release agent a removable sun protective sheet (not shown) may be applied to the first side 108 of the contact plate portion 144.

Figure 4:
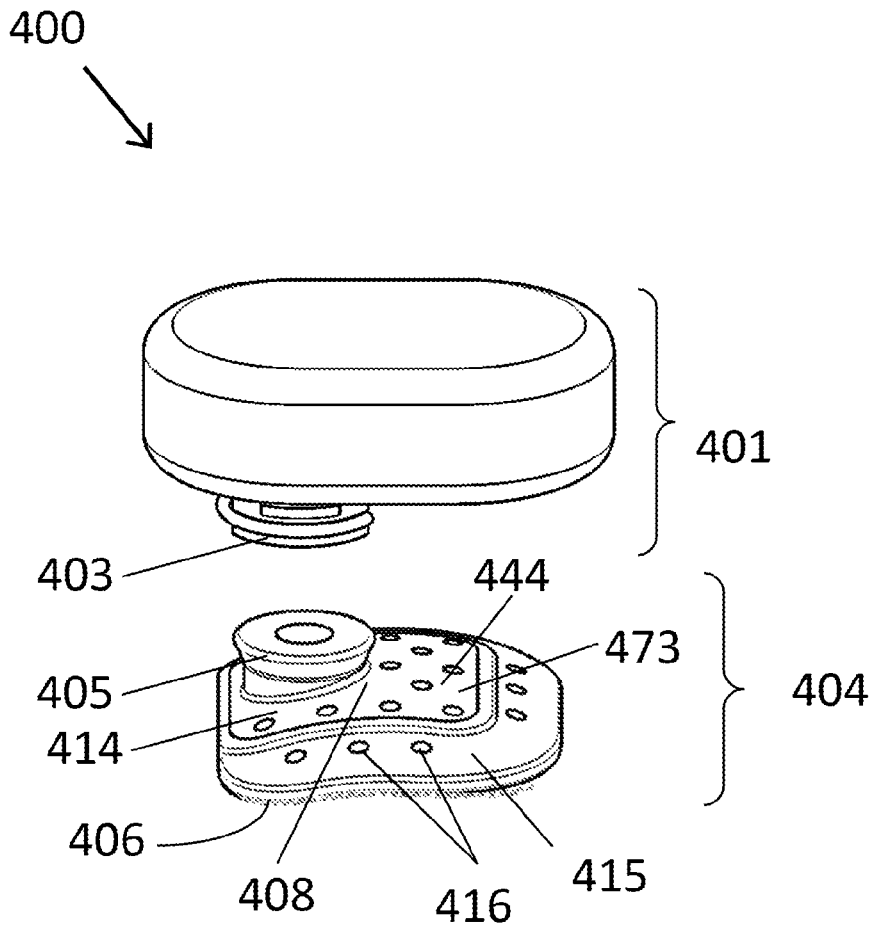
FIG. 4 is a perspective side view of an embodiment of the bone conduction hearing aid system of the present invention with a flexible female connection portion of the hearing aid device and a corresponding male connection portion on the first side of the interconnection unit.

FIG. 4 is a perspective side view of the bone conduction hearing aid system 400 of the present invention. A hearing aid device 401 has a first connection portion 403. An interconnection unit 404 has contact plate portion 444 having a first side 408, and a conical-shaped connection portion 405. The interconnection unit 104 has an adhesive side 406. The bone conduction hearing aid system 400 is similar to the embodiment shown in FIG. 1, however, the first connection portion 403 and the second connection portion 405 are different. The interconnection unit 404 also has a flexible portion 415 that is a flexible rubber frame. The first connection portion 403 is a female coupling that has a flexible portion and a recess defined therein. The connection portion 405 may be a rigid male coupling so that the flexible female coupling of the connection portion 403 can be snapped onto the male coupling of the connection portion 405. Because an inner diameter of the recess of the flexible female coupling is slightly smaller than an outer diameter of the male coupling, the flexible and elastic female coupling of first connection portion 403 generates a coupling force about the male coupling of the connection portion 405 that keeps the hearing aid device 401 and the interconnection unit 404 together. The dimensions are chosen so that the contact plate 444 portion is not too thick (in the magnitude of 1 mm) for cosmetic reasons and the connection portion 105 protrudes at least 50% of an average thickness of the contact plate portion so that it is sufficiently to facilitate finding the connection portion 105 when attaching the hearing aid device 101 to the interconnection unit 104. The contact plate portion 444 has a first side 414. The contact plate portion 444 has a fairly rigid plate portion 473 and a softer flexible and bendable peripheral portion 415 to facilitate adhesion of the adhesive surface 406 to skin surfaces of various curvatures. Because the rigid portion 473 is sufficiently rigid, it makes it easier for the user to separate connection 403 from connection 405, especially when disconnecting, the hearing aid device 401 by tilting the hearing aid device 101 in relation to the interconnection unit 404. It is an important feature that the interconnection unit 404 both has a flexible portion 415 that is adaptable to the curvature of the skull of the patient while the rigid portion 473 makes it easier to remove the hearing aid device 401 from the interconnection unit 404. The flexible rubber frame 415 provides an important function in that it improves retention and reduces pressure against the skin. The interconnection unit 404 has through holes 416 extending therethrough for air and moisture transportation to and from the skin through the interconnection unit 404, see also FIG. 7.

Figure 5:
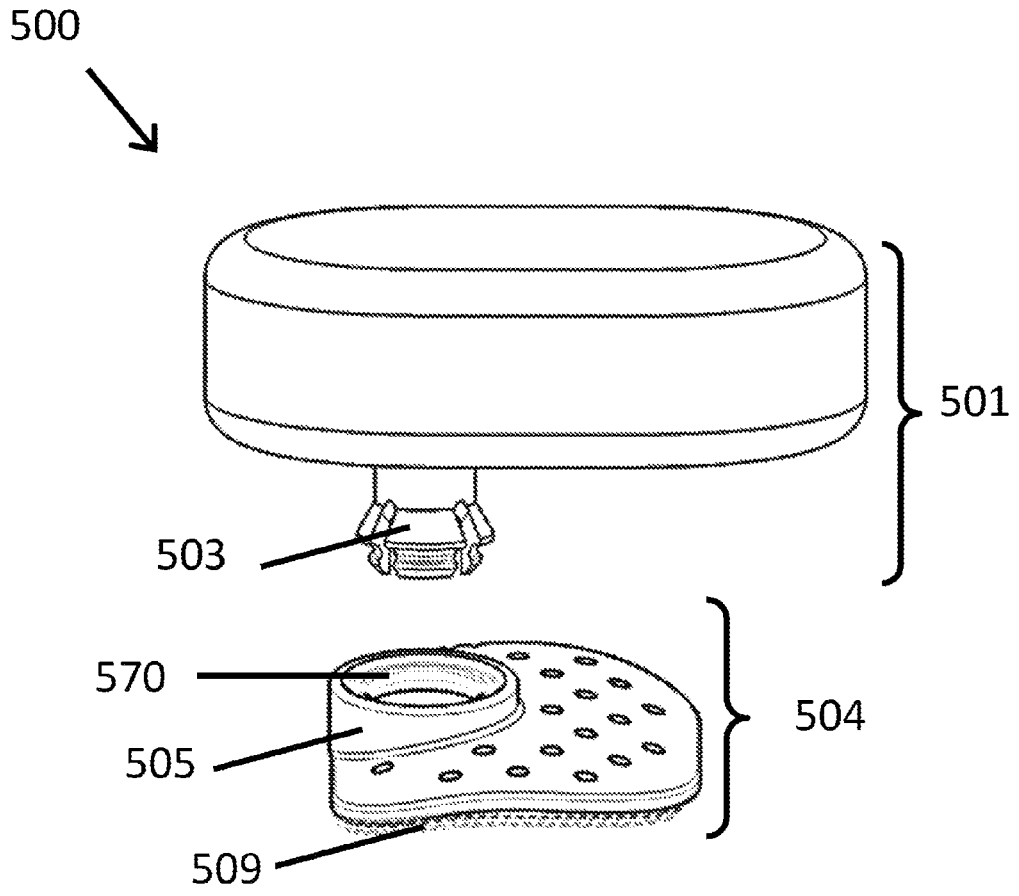
FIG. 5 is a perspective side view of an embodiment of the bone conduction hearing aid system of the present invention with a flexible male connection portion of the hearing aid device and a corresponding female connection portion on a first side of the contact plate portion.

FIG. 5 is a perspective side view of the bone conduction hearing aid system 500 of the present invention. The embodiment shown in FIG. 5 is very similar to the embodiment shown in FIG. 1 except that the positions of the male and female connections have been switched so that the female coupling is on the interconnection unit while the male coupling is on the hearing aid device. More particularly, a hearing aid device 501 has a first male connection portion 503. An interconnection unit 504 has a second connection portion 505 and an adhesive component 509. The first portion 503 is a flexible male coupling so that it can be removably snapped into the female portion 505. The female connection portion 505 has a recess 570 defined therein so that the first connection portion 503 can be retained to the portion 505.

Figure 6:
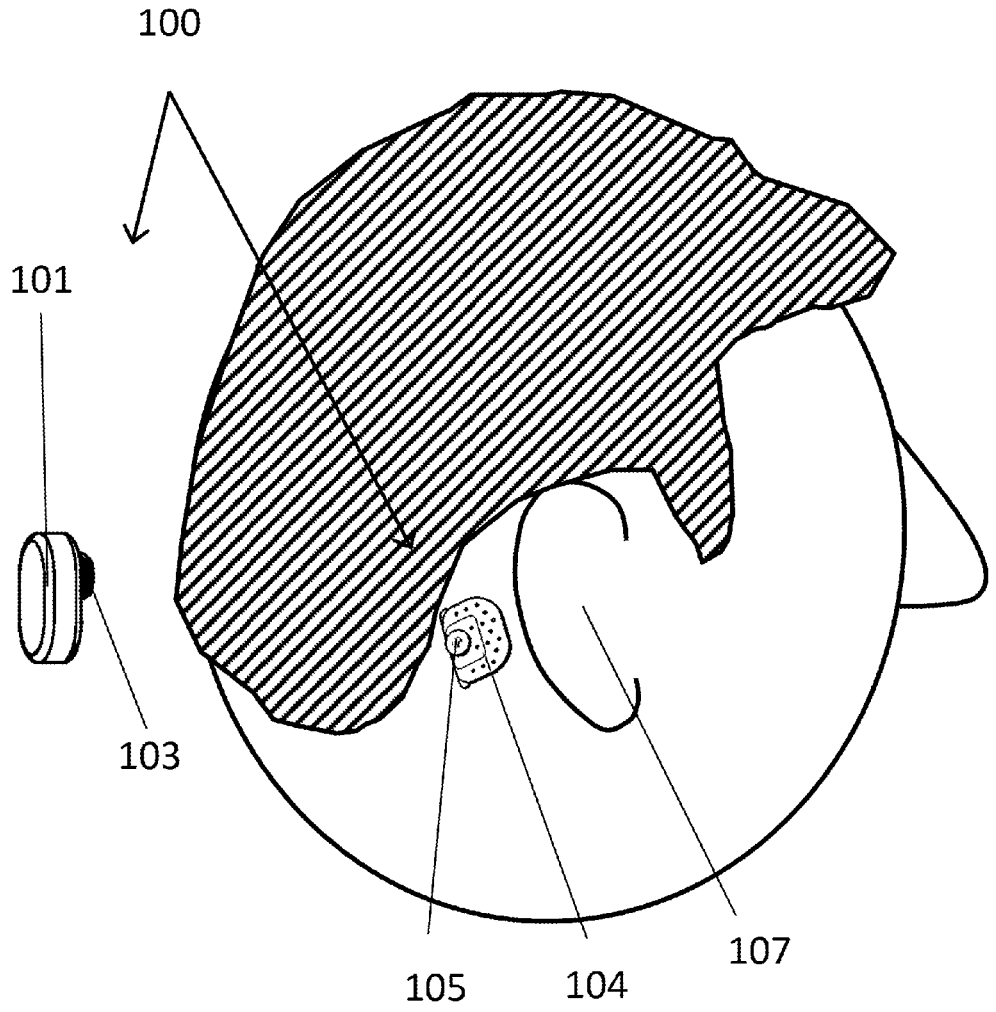
FIG. 6 is a perspective side view overviewing the bone conduction hearing aid system of the present invention when the bone conduction hearing aid device has been disconnected from the interconnection unit attached to a user.

FIG. 6 is a perspective side overview of the bone conduction hearing aid system 100 of the present invention. This figure shows the same embodiment as in FIG. 1, however here the bone conduction hearing aid device 101 has been disconnected from the interconnection unit 104 adhesively attached to the skin behind the ear 107 of the user. The hearing aid device 101 has a first connection portion 103 that can be connected to the second connection portion 105 on the interconnection unit 104.

FIGS. 7A-7C are perspective views of an interconnection unit 704 of the bone conduction hearing aid system of the present invention shown from different angles. In FIG. 7A, the interconnection unit 704 has a contact plate portion 744 having a first side 708 and a second side 720 (best shown in FIGS. 7B and 7C) opposite to the first side 708. The interconnection unit 704 has a connection portion 705 that is a flexible male connection portion. The connection portion 705 is insertable into a first connection portion of a hearing aid device (such as first connection portion 103 shown in FIG. 1). The contact plate portion 744 has a fairly rigid plate portion 773 and a softer flexible and bendable peripheral portion 715 to facilitate adhesion of the adhesive surface 706 of the adhesive component 709 to skin surfaces of various curvatures. The interconnection unit 704 has through-holes 716 for air and moisture transportation through the contact plate portion 744. The contact plate portion has a front end 742 and a rear end 741, and the connection portion 105 is located closer to the rear end 742. The adhesive surface 709 is intended to be attached to the hairless skin area behind the ear of a user. FIG. 7B is a perspective bottom view of the interconnection unit 704 of FIG. 7A. The flexible portion 715 of the contact plate portion 744 has a curved shape to better conform to the shape of the bone area behind the ear of users. The second side 720 of the contact plate portion 744 is covered by an adhesive component 709 (therefore second side 720 is not visible here) that has an adhesive side 706 that enables the interconnection unit 704 to be connected to the skin of a user (not shown). The through holes 716 extend through both the adhesive component 709 and the contact plate 744. A design where the through holes only go through the contact plate portion 744 and not through the adhesive component 709 is also possible, especially if moisture can be transported through the material of the adhesive component 708. This may a suitable solution when the adhesive component 709 is made of a non-woven material. Preferably, the adhesive component 709 follows the contour of the concave shape of the second side 720 of the contact plate portion 744. When the interconnection unit 704 is attached to the head of a user, the unique combination of the concave surface facing the usually convex shape of the head, the flexible portion 715 adapts to different curvatures. The fact that there are no portions protruding from the contact surface ,i.e. the second surface 720, into the skin of the user provides a solution with optimal skin adhesion. This means the interconnection unit 704 can carry a heavier hearing aid device (such as hearing aid device 101 shown in FIG. 1) without the hearing aid system falling off from the head of a user to which it is adhesively attached. The concave shape of the second side of the contact plate portion 744 is more concave in a direction from the front end 742 to the rear end 741 than in a direction along the contact plate portion perpendicular to the direction from the front end 742 to the rear end 741 which is important to better adapt to the curvature of the head behind the ear of a user.

FIG. 7C is a bottom view of the interconnection unit 704. The second side 720 of the contact plate portion 744 is covered by the adhesive component 709 that has the adhesive side 706. The through holes 716 extend through the interconnection unit 704. The dashed line (L) indicates the limitation of the rigid portion 773 of the contact plate portion 744 (shown in FIG. 7A).

The vibrator of the present invention may be any suitable type of vibrator such as an electromagnetic vibrator or a piezoelectric vibrator. The amplifier of the hearing aid device may, for example, include digital processing, directional microphones, noise reduction, feedback suppression and other electronic and software features that are beneficial and used in any suitable type of regular hearing aid. The hearing aid device may consist of one housing unit where all electronics are included, or it may consist of two or more separate housing units where different parts of the electronics are included in the different housings and where the separate housing units communicate with each other via wire or wireless communication.

The bone conduction hearing aid system of the present invention can be used as a long term treatment for patients with, for example, conductive hearing losses. The bone conduction hearing aid system of the present invention can also be efficient for the rehabilitation of temporary hearing losses due to various middle ear conditions, and it may also be used as a temporary hearing solution to evaluate bone conduction hearing for a patient to decide whether a surgical bone conduction bone conduction hearing aid should be applied on a patient.

The bone conduction hearing aid system of the present invention may also be a bone conduction tinnitus masker used to reduce the handicap of tinnitus, and it may also be applied as a bone conduction stimulator in audiometry to determine bone conduction hearing.

In the past, it has been assumed that it is necessary to apply a fairly high pressure to transmit bone conduction vibrations through the skin regardless of whether the bone conductor has been applied with an elastic or adhesive arrangement. In the present invention, it has been surprisingly realized that bone conduction work efficiently also without any specific pressure applied against the skin, the vibrations from the hearing aid system are properly and effectively being conveyed into the skull of the user while holding the hearing aid system in place so that the user can move without the hearing aid system undesirably moving or falling off. The fact that no or very little pressure is being applied on the skin is more comfortable to the user and reduces the risk for not only discomfort in the area of attachment but also enhances the general comfort of the user because there is less strain on the skull. Another important feature is that the adherence is sufficiently strong so that the user can easily snap on and snap off the hearing aid device from the interconnection unit without tearing off the interconnection unit from the skin. This makes it possible for the user to only attach the hearing aid device to the interconnection unit when necessary but also the user can easily remove it without removing the interconnection unit when needed such as when sleeping or swimming. The interconnection unit that is more frequently changed and cost efficient to manufacture may be manufactured in various shapes and sizes to fit different users, and it may even be possible to do it individual by 3D-printing or by forming it with heat etc. The contact plate portion may preferably have a rounded triangular shape to optimally use the non-hair-baring area behind the ear of a user.

For all of the above embodiments several alternative designs and combinations are possible and the invention is not limited to the preferred embodiments presented above. While the present invention has been described in accordance with preferred compositions and embodiments, it is to be understood that certain substitutions and alterations may be made thereto without departing from the spirit and scope of the following claims.

The invention claimed is:

1. A bone conduction hearing aid system, comprising, a hearing aid device having a vibrator disposed in a hearing aid housing, the hearing aid device having a first connection portion; and an interconnection unit having a contact plate portion;

the contact plate portion having a first side having a second connection portion and a second side at least partly provided with an adhesive component;

the adhesive component having a first adhesive side and a second adhesive side;

the first adhesive side being attached to the second side of the contact plate portion and the second adhesive side being adhesively attachable to a skin of a user;

the first connection portion being removably connectable to the second connection portion;

the second connection portion of the interconnection unit being integral with the contact plate portion;

one of the first and the second connection portion being a female connection portion and the other of the first and the second connection portion being a male connection portion, and the male connection portion being at least partly insertable into the female connection portion, one of the female and the male connection portion being flexible with a snap-in ridge and the other of the first and the second connection portion having a circular rigid coupling ridge; and the second side of the contact plate portion being concave or planar without convex areas and without any component protruding from the second side of the contact plate portion of the interconnection unit.

2. The bone conduction hearing aid system according to claim 1, wherein the interconnection unit has a total weight of less than 2 grams.

3. The bone conduction hearing aid system according to claim 1, wherein the second connection portion and the contact plate portion is made of a one piece injection molded continuous thermoplastic polymer material.

4. The bone conduction hearing aid system according to claim 1, wherein the contact plate portion has at least five through holes defined therein extending from the first side to the second side of the contact plate portion.

5. The bone conduction hearing aid system according to claim 1, wherein the contact plate portion has a front end and a rear end, and the second connection portion is non-centrically positioned on the first side of the contact plate portion so that the front end of the contact plate portion extends at least twice as far out from a center point of the second connection portion compared to the extension of the rear end of the contact plate portion from the center point of the second connection portion.

6. The bone conduction hearing aid system according to claim 1, wherein the first connection portion is a rigid female connection portion and the second connection portion is a flexible male connection portion, and wherein the flexible male connection portion has at least two flexible spring arms having a snap-in ridge at a connection end of the spring arms.

7. The bone conduction hearing aid system according to claim 1, wherein the second connection portion is a rigid male connection portion protruding a distance out from the surface of the first side, the distance being at least 50% of an average thickness of the contact plate portion.

8. The bone conduction hearing aid system according to claim 1, wherein the contact plate portion has a flexible peripheral frame around at least part of the periphery of the contact plate portion.

9. The bone conduction hearing aid system according to claim 1, wherein the contact plate portion is at least partly transparent to allow at least one of visible light and UV light to be transmitted through the contact plate portion to the adhesive component.

10. The bone conduction hearing aid system according to claim 9, wherein the adhesive component has a light or UV light sensitive switchable release agent that is transformable to change at least the adhesive of the second adhesive side from a high adhesive state providing a high adhesive strength to a low adhesive state providing a low adhesive strength that is lower than the high adhesive strength.

11. The bone conduction hearing aid system according to claim 1, wherein the adhesive component is a doubled sided adhesive sheet with a non-woven carrier material.

* * * * *